US005167553A

United States Patent [19]

Wilson

[11] Patent Number: 5,167,553

[45] Date of Patent: Dec. 1, 1992

[54] FOOT STRAP FOR SURFBOARD

[76] Inventor: Kurt D. Wilson, 1279 S. Orlando Ave., Cocoa Beach, Fla. 32931

[21] Appl. No.: 819,263

[22] Filed: Jan. 10, 1992

[51] Int. Cl.[5] ..... A63C 15/06

[52] U.S. Cl. ..... 441/75; 280/615

[58] Field of Search ..... 441/69, 74, 75, 70, 441/68; 280/615

[56] References Cited

U.S. PATENT DOCUMENTS 4,285,082 8/1981 Cox ..... 441/74
4,645,466 2/1987 Ellis ..... 441/74
4,775,345 10/1988 Gifford ..... 441/74

*Primary Examiner*—Jesus D. Sotelo
*Attorney, Agent, or Firm*—James H. Beusse

[57] ABSTRACT

A foot strap system for surfboards that allows the surfer to lie upon the strap in a prone paddling position without discomfort yet allows the easy insertion of the foot as the surfer stands. The system comprises a collapsible foot strap having an integral, arch shaped, resilient reinforcement and a surrounding pad which creates a recess into which the strap will collapse. The body of the strap is wide relative to its thickness. The flat, curved reinforcement member within the body of the strap imparts to the strap a curved shape. The reinforcement is sufficiently flexible to allow the strap to be substantially flattened, yet resilient enough to return the strap to its naturally curved form. When mounted to the surfboard, one end of the strap is secured with its curved, reinforced portion very near the mounting to create a flexible "hinge" with sufficient rigidity to hold the strap in an upright "open" position. At the other end of the strap, between its curved reinforced portion and mounting, there is a short, pliable section which forms a fold as the strap flattens. The strap is thereby allowed to be repeatedly flattened and returned to its normal arched form.

8 Claims, 4 Drawing Sheets

FOOT STRAP FOR SURFBOARD

The present invention relates to surfboards and, more particularly, to a foot strap assembly for use on a surfboard.

BACKGROUND OF THE INVENTION

In recent years surfing has undergone a dramatic evolution. Influenced by skateboarding, windsurfing and snowboarding, today's surfers are pushing the limits of surfing beyond the confines of the wave face and into the air. In the 60's, surfer would try to "hang ten" on heavy "longboards". Today, they are attempting new and increasingly gymnastic maneuvers called "aerials", riding small, lightweight surfboards. Aerials are now recognized as the moves of the future in surfing.

Because modern surfboards allow a great deal of speed and maneuverability, "getting air" has become relatively easy for the accomplished surfer. The difficultly, even for the best, is in staying with the board once in the air and achieving a controlled landing. Surfers are forced either to execute the maneuver so that the board stays in position under the surfer while in the air, which is extremely difficult, or grab the "rail" (outside edge) of the board with the hand or hands to hold it in position. The latter forces the surfer out of his natural stance and does not allow the use of his arms and upper body. This has an extremely limiting effect on the surfer's ability to control the maneuver.

Obviously, some means of attachment of surfer to surfboard would be of great benefit in the performance of aerials. While there have been attempts to accomplish this by various means, none have proven acceptable in practice. The methods employed in known devices have, for the most part, taken one of three basic forms. Shoes or sandal-like footwear have been fitted with hook & loop (Velcro) designed to adhere to like material applied to the deck of the board. Suction cups have been used in a similar fashion. Finally, foot straps, similar to those used on sailboards, have been attached to the board. Although all of these devises can secure a surfboard to the surfers feet, all suffer from problems that have, up to now, prevented them from being accepted into common use.

The major drawback to hook & loop and suction cup devises is that they cause a surfer's feet to become generally fixed wherever they first make contact with the surfboard. In practice, a surfer's feet are seldom perfectly placed upon standing, and nearly always require some adjustment before he can perform effectively. If the attachment of surfer to board is strong enough to hold during extreme, and especially aerial, maneuvers it will not allow this adjustment. Conversely, if the strength of the attachment allows repositioning of the feet it will be so weak as to render the system ineffective.

Unlike hook & loop and suction cup devices which have been used on both the front and back feet, foot straps have been used mostly for the front foot. the mechanics of rising from a prone to a standing position on a surfboard make the use of a foot strap truly viable for the front foot only. This is not as detrimental as it might seem, however, since it is often necessary to move the rear foot up or back when performing various maneuvers. For example, when surfing very small waves, the rear foot will often be moved well forward of its normal position. Since the front foot is normally positioned nearer the center of gravity of the surfboard, a front foot attachment alone is usually effective in manipulating the surfboard and controlling it in flight than a back foot attachment alone. While the lack of a rear foot attachment could be considered a drawback to the foot strap approach, this lack does not negate the positive aspects of a foot strap. Primarily the advantage of a foot strap over hook & loop and suction cup approaches is that the foot strap helps guide the foot into an optimum position before securing it there.

One disadvantage of the foot strap approach is that when the surfer is up and riding, the surfer's front foot is desirably positioned in the same area of the board as the chest occupies when lying prone in a paddling position. If the strap is mounted in an arched configuration so that the front foot will slide naturally and easily into position beneath it, the strap will be too uncomfortable and even painful to lay upon. If the strap lays flat upon the deck of the board so that it does not pose a problem when paddling, it will be unacceptably difficult to place the foot under the strap when standing. A foot strap designed for the front foot that would permit the quick and easy placement of the foot beneath it while allowing the surfer to lie upon it without discomfort would be a significant advantage.

SUMMARY OF THE INVENTION

The present invention is a foot strap system for surfboards that allows the surfer to lie upon the strap in a prone paddling position without discomfort yet allows the easy insertion of the foot as the surfer stands. The system comprises a collapsible foot strap having an integral, arch shaped, resilient reinforcement and a surrounding pad which creates a recess into which the strap will collapse. The body of the strap is wide relative to its thickness. The flat, curved reinforcement member within the body of the strap imparts to the strap a curved shape. The reinforcement is sufficiently flexible to allow the strap to be substantially flattened, yet resilient enough to return the strap to its naturally curved form. When mounted to the surfboard, one end of the strap is secured with its curved, reinforced portion very near the mounting to create a flexible "hinge" with sufficient rigidity to hold the strap in an upright "open" position. At the other end of the strap, between its curved reinforced portion and mounting, there is a short, pliable section which forms a fold as the strap flattens. The strap is thereby allowed to be repeatedly flattened and returned to its normal arched form.

In a preferred form, the strap is attached to the board with 3M Dual Lock reclosable fastenings. Dual Lock fasteners are similar to Velcro type fasteners in function but utilizes interlocking mushroom shaped stems rather than hooks and loops, wherein both of these can be categorized as using interlocking plastic projections. In order to provide the contact area needed to assure a sufficiently strong mounting, the fastening ends of the foot strap are fitted with plates covered with Dual Lock fastenings and patches of Dual Lock fastenings are attached to the deck of the surfboard in those areas where the ends of the strap are expected to be mounted. The plates are designed so that they do not too easily bend and peel up when the strap is pulled upon, but can be readily detached by the user for the removal or repositioning of the strap. This is accomplished by making the center of the plates stiff and rigid, where the strap is attached, while keeping the perimeter of the plates flexible. Bending up and disengaging the flexible edges of the plate reduces the amount of contact area and allows the user to grip the plate and pry it off. When pulling up on the strap, however, the stiff center causes the plate to react very much as it would if it were rigid throughout.

BRIEF DESCRIPTION OF THE DRAWINGS

For a better understanding of the present invention, reference may be had to the following detailed description taken in conjunction with the drawings in which.

DETAILED DESCRIPTION OF THE INVENTION

Figure 1:
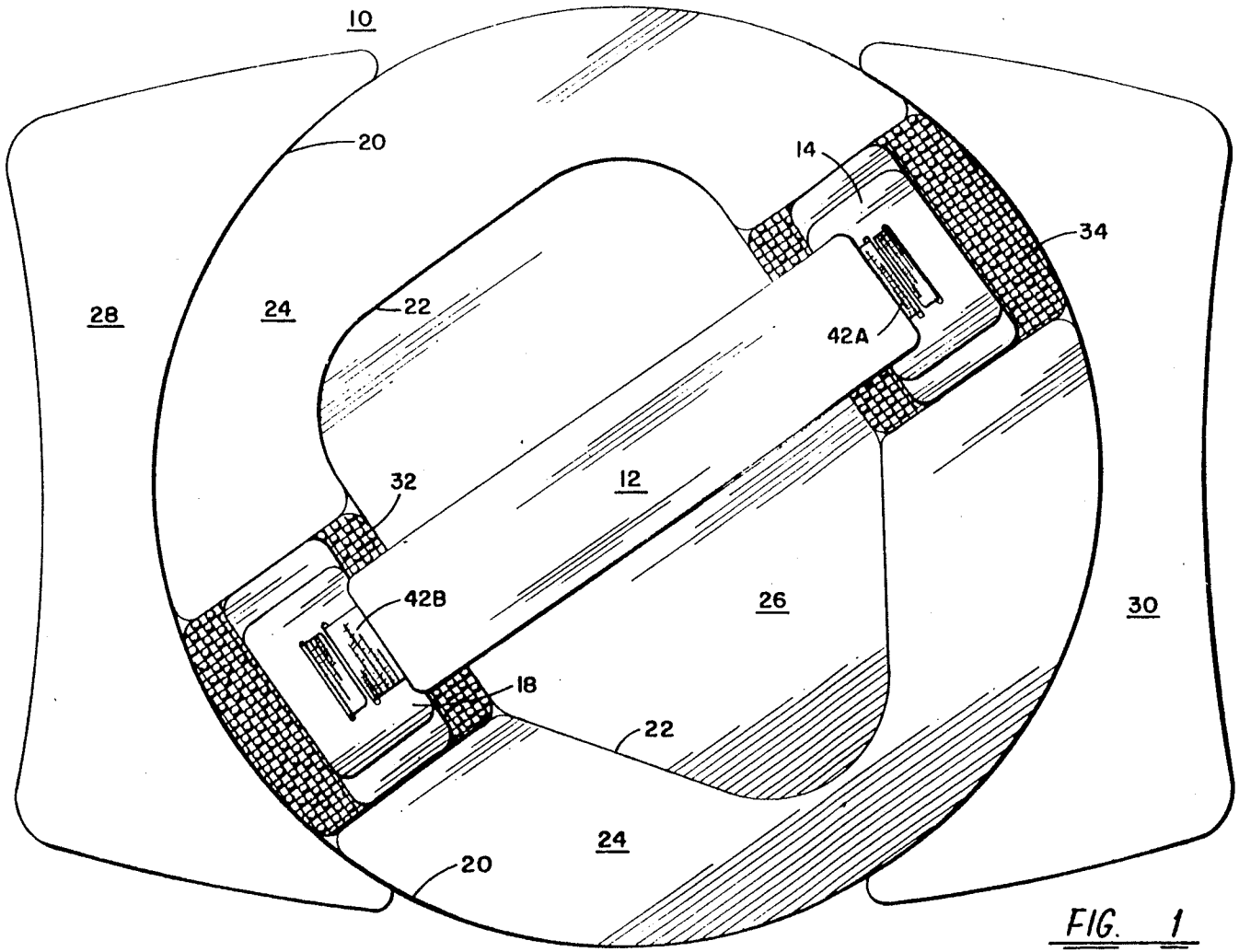
FIG. 1 is a top plan view of a foot strap assembly in accordance with the present invention.
Figure 2:
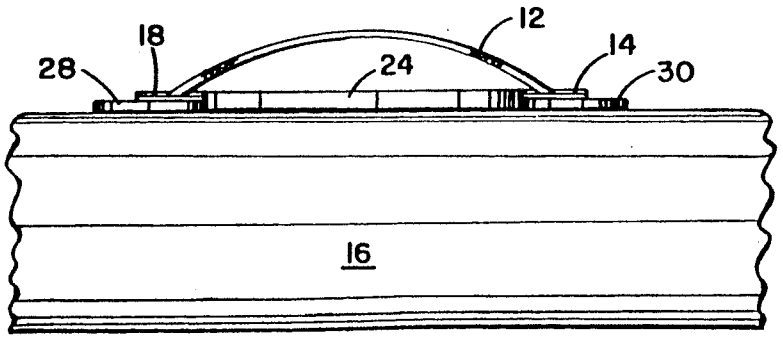
FIG. 2 is a partial elevation view of the invention of FIG. 1.

Referring to the drawings generally and in particular to FIGS. 1–2, FIG. 1 is a top, plan view of a foot strap assembly 10 in accordance with a preferred form of the invention and FIG. 2 is a profile view of the assembly of FIG. 1. The foot strap is shown at 12 extending from a first fastening means 14 pivotally attached to a surface of a surfboard 16 to a second fastening means 18 flexibly attached to surfboard 16. In a normal configuration, the strap 12 has a generally arcuate shape as shown in FIG. 2 to facilitate placing of a foot strap when a surfer assumes a standing position on the board 16.

The area demarcated by the lines 20, 22 represents a relatively low density polyethylene foam pad 24 circumscribing the area 26. The pad 24 is approximately the thickness of the strap 12 and establishes a generally regular surface for supporting the chest of a surfer lying prone on the surfboard. The area 26 may be covered by a relatively thin, high density polyethylene foam to provide a gripping surface for the surfer's foot. The areas 28 and 30 are foam pads slightly thinner than pad 24, as shown in FIG. 2, and provides a transition from the board surface to the pad 24.

Each of the fastening means 14 and 18 are substantially identical. In a preferred embodiment, a releasable fastening material such as 3M Corp. Dual Lock material is used to couple the means 14, 18 to the surfboard surface. Dual Lock material is an improvement over hook and loop type fastening material distributed under the trademark Velcro. Dual Lock material uses interlocking mushroom shaped stems on each mating part and is believed to have a higher holding strength than Velcro type material. Pads of Dual Lock material are adhesively bonded to the surfboard 16 at 32 and 34. These pads 32 and 34 are preferably larger than the fastening means 14,18 to allow some adjustment of the positioning of the ends of the strap 12. Mating Dual Lock material is adhesively bonded to the lower surface of the fastening means 14,18 for coupling to pads 32,34. The size of the fastening means 14,18 is selected to provide sufficient holding strength to prevent separation during acrobatic use of the surfboard. In one form, each of the means 14,18 measure about four inches by two inches.

Figure 3:
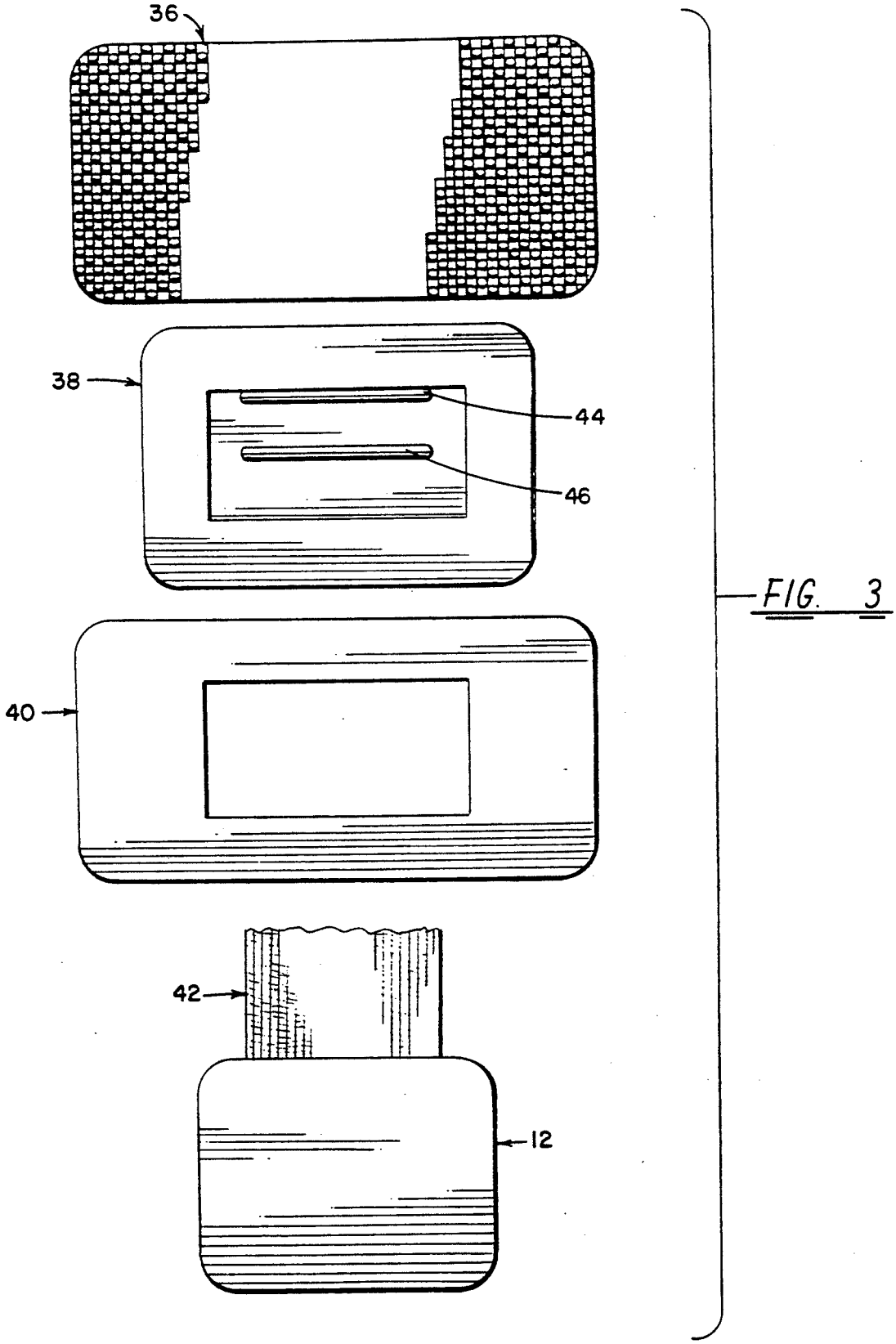
FIG. 3 is an exploded view of a fastening for use with the invention of FIG. 1.
Figure 4:
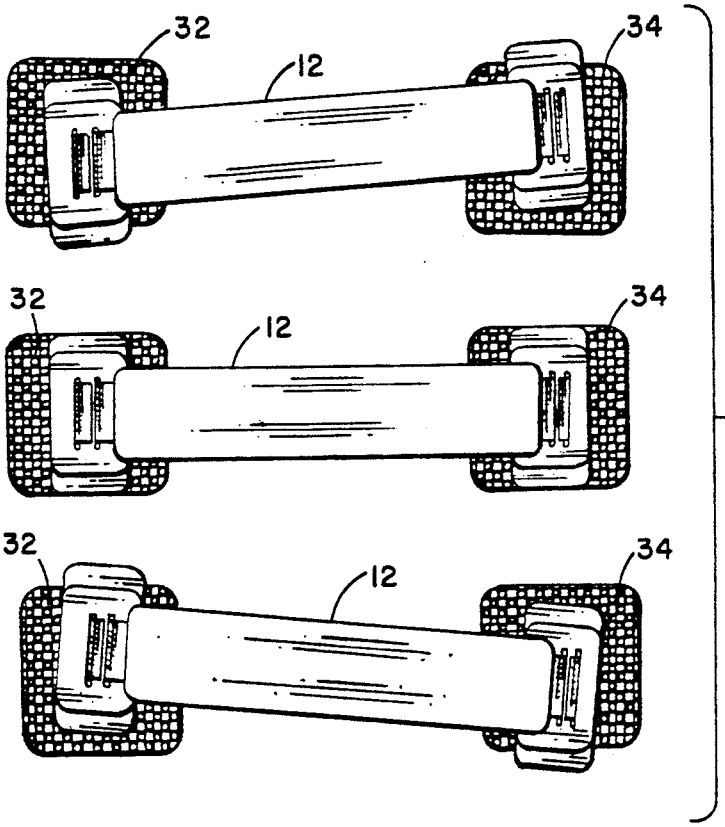
FIGS. 4–5 illustrates connection utilizing the fastening of FIG. 3.
Figure 5:
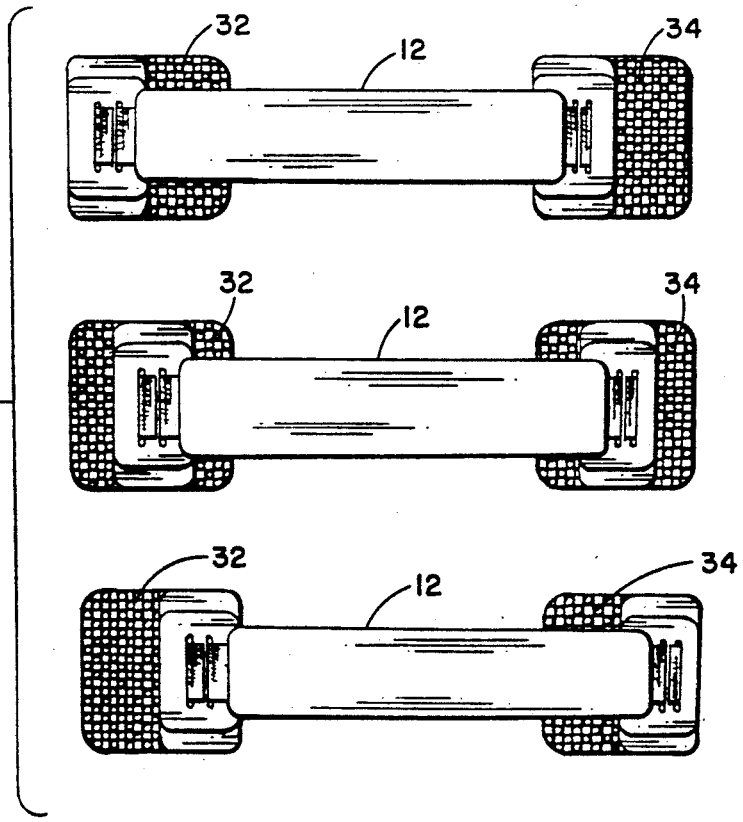

Because the interlocking Dual Lock material provides a strong bond against separation forces normal to the plane of the material, it is desirable to provide a means for allowing relatively easy separation for adjustment purposes. Turning to FIG. 3, the fastening means, both 14 and 18, are each comprised of a sheet of Dual Lock material 36 on a lower contact surface, an intermediate, relatively rigid plate 38 and an upper polyethylene foam cover 40. The strap 12 has an attached webbing member 42 which can be inserted in slots 44,46 in plate 38 and then adhesively bonded to plate 38. The plate 38 is centered on sheet 36 and adhesively bonded thereto. The cover 40 is adhesively bonded to the plate 38 and underlying sheet 36. The plate 38 may be formed of a fiberglass/epoxy material with a thickness of about one millimeter. The portion of the material sheet 36 and cover 40 extending beyond the perimeter of plate 38 provides a flexible portion which can be initially grasped and pulled up in order to start separation of the fastening means so as to reduce the required separation force and allow relatively easy adjustment of the position of the fastening means on the pads 32,34. Such positioning may be desirable to accommodate a left foot versus a right foot as the forward foot on the surfboard or to merely fine-tune the position to accommodate a particular surfer or to tighten the strap 12. For example, FIG. 4 illustrates various angular positions of strap 12 and FIG. 5 illustrates longitudinal adjustment of strap 12.

Figure 6:
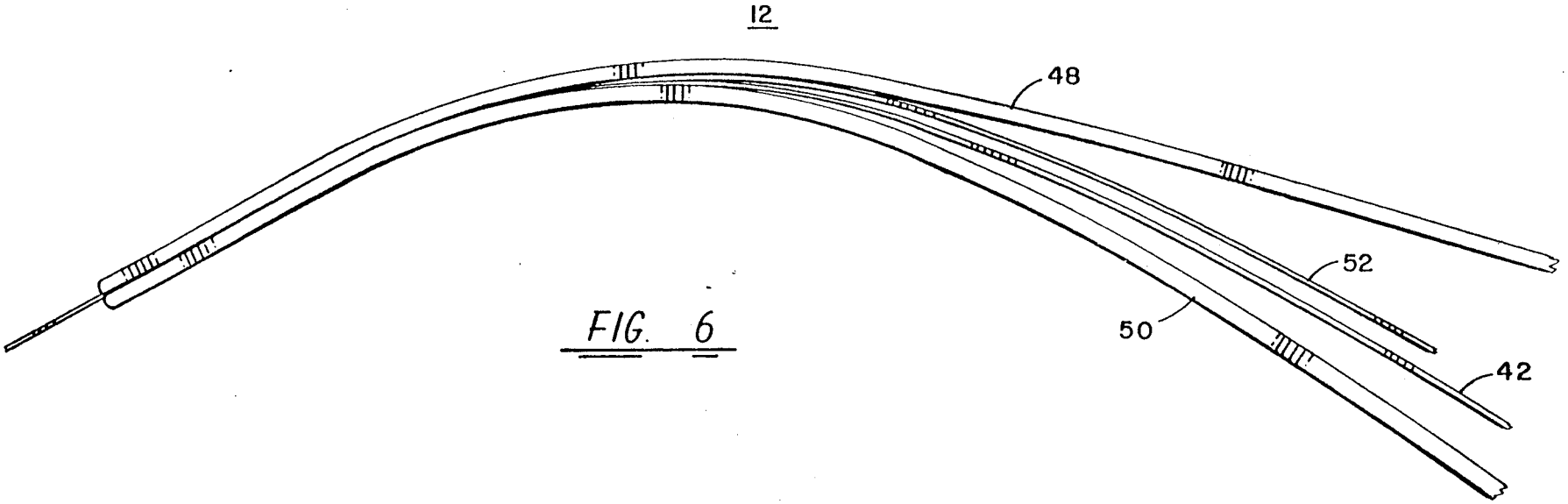
FIG. 6 illustrates the construction of a strap for use in the present invention.

Turning now to FIG. 6, there is shown a preferred form of the strap 12. The strap includes an outer pad 48, an inner pad 50 and a plate-like spring member 52 sandwiched between pads 48 and 50. Each of the pads 48,50 are polyethylene foam material with pad 48 being a high-density material and pad 50 being a low-density material. The webbing material 42 extends through the strap 12 with opposite ends extending beyond the ends of strap 12 to provide a means to connect the strap 12 to each of the fastening means 14 and 18. The inner pad, outer pad, webbing material and spring member are adhesively bonded to form the strap 12 as a unitary structure. The spring member 52 acts to give the strap an elastic quality, i.e., it can be pressed downward and flattened against the surfboard surface and then will return to its arcuate shape when pressure is released. The member 52 can be formed of epoxy-fiberglass having about a one millimeter thickness.

Referring again to FIG. 1, the strap 12 is constructed such that the webbing end 42A pulls the adjacent end of strap 12 relatively tightly against the fastening means 14. This arrangement fixes an end of strap 12 against means 14 such that the webbing end 42A forms a pivotable hinge-like connection between strap 12 and means 14. At the opposite end of strap 12, webbing end 42B has a preselected extent between fastening means 18 and the adjacent end of strap 12. The resultant spacing between the strap and means 18 allows the webbing end 42B to fold over when the strap is pushed downward to thereby accommodate the longitudinal motion of the end of strap 12 while restraining the end of strap 12 when the strap is in its normal arcuately shaped orientation.

A significant advantage of the described system is that all elements can be adhesively bonded to the surfboard thus eliminating any requirement for holes, screws or rivets which might weaken the board. The system is also easily attached to the board since the polyethylene pads are easily provided as pre-glued with peel and removal protective sheets. Thus, no tools are required for installing the foot strap assembly. The connection between the strap 12 and pads 32,34 is also easily adjusted to provide different strength attachment by appropriate signing of the fastening means 14,18. The entire strap assembly is also easily adjusted during installation to accommodate either a left or right foot forward position during standing on the board.

While the invention has been described in what is considered to be a preferred embodiment, various modifications will be apparent to those skilled in the art. It is intended therefor, that the invention not be limited to the disclosed embodiment but be interpreted within the spirit and scope of the appended claims.

What is claimed is:

1. A foot strap and means for attachment thereof to a surfboard, comprising:

an elastic strap member comprising an inner pad, an outer pad and a leaf spring member sandwiched between said inner and outer pads, said spring member having a generally arcuate shape for establishing a generally arcuate shape of said strap member;

first fastening means coupled to a first end of said strap member for pivotally attaching said strap member to a surfboard;

second fastening means coupled to a second end of said strap member for attaching said strap member to the surfboard, said second fastening means having a flexible portion for allowing said strap member to extend into a flattened configuration on a surface of the surfboard.

2. The apparatus of claim 1 wherein said first and second fastening means are releasably coupled to the surfboard.

3. The apparatus of claim 2 wherein each of said fastening means are coupled to the surfboard through an interlocking releasable fastening material.

4. The apparatus of claim 3 wherein each of said fastening means comprises a relatively rigid, flat first member and a flexible sheet member, said sheet member having one member of said interlocking releasable fastening material forming one surface thereof, another surface of said sheet member being bonded to said first member, and said sheet member being larger than said first member such that edges of said sheet member extend beyond corresponding edges of said first member.

5. The apparatus of claim 4 and including mating members of said interlocking fastening material bonded to the surface of the surfboard for releasable connecting to each of said fastening means.

6. The apparatus of claim 5 and including a foot placement area defined on the surface of the surfboard generally circumscribing said foot strap, said placement area being defined by a pad circumferentially thereof, said pad having a thickness generally coextensive with said foot strap for providing a generally regular surface when said foot strap is flattened onto the surface of the surfboard.

7. The apparatus of claim 6 wherein said pad comprises a resilient material.

8. The apparatus of claim 5 and including a continuous, flexible strap extending through said foot strap between said inner and outer pads, one end of said strap being attached to said first fastening means and another end of said strap being attached to said second fastening means.

* * * * *